US007044746B2

(12) United States Patent
Copper et al.

(10) Patent No.: US 7,044,746 B2
(45) Date of Patent: May 16, 2006

(54) SEPARABLE INTERFACE ELECTRICAL CONNECTOR HAVING OPPOSING CONTACTS

(75) Inventors: Charles Dudley Copper, Harrisburg, PA (US); Craig Maurice Campbell, Camp Hill, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/271,483

(22) Filed: Oct. 16, 2002

(65) Prior Publication Data

US 2004/0077202 A1 Apr. 22, 2004

(51) Int. Cl.
*H01R 12/00* (2006.01)

(52) U.S. Cl. ..... 439/66; 439/71

(58) Field of Classification Search ..... 439/66, 439/71

See application file for complete search history.

(56) References Cited

U.S. PATENT DOCUMENTS

| | | | | |
|---|---|---|---|---|
| 3,377,514 | A * | 4/1968 | Ruehlemann et al. | 361/767 |
| 4,204,722 | A * | 5/1980 | Yasui et al. | 439/71 |
| 4,857,001 | A * | 8/1989 | Nakano et al. | 439/68 |
| 5,464,355 | A * | 11/1995 | Rothenberger | 439/559 |
| 5,646,442 | A | 7/1997 | Abe et al. | |
| 6,276,941 | B1 * | 8/2001 | Wu | 439/66 |
| 6,287,151 | B1 * | 9/2001 | Matsuzaki et al. | 439/630 |
| 6,722,896 | B1 * | 4/2004 | McGrath et al. | 439/71 |
| 6,767,222 | B1 * | 7/2004 | Murr et al. | 439/71 |
| 6,786,738 | B1 * | 9/2004 | Lin | 439/71 |

* cited by examiner

*Primary Examiner*—Thanh-Tam Le

(57) ABSTRACT

A electrical connector system comprising a plug assembly and a socket assembly. The plug assembly includes a plurality of conductive pads. The socket assembly includes a first set of spring contacts and a second set of spring contacts. The first set of spring contacts are oriented in a direction opposing an orientation of the second set of spring contacts. Each spring contact within the first and second sets of spring contacts contact one of the plurality of conductive pads.

23 Claims, 5 Drawing Sheets

SEPARABLE INTERFACE ELECTRICAL CONNECTOR HAVING OPPOSING CONTACTS

BACKGROUND OF THE INVENTION

Embodiments of the present invention generally relate to a separable interface connector, and more particularly relate to a separable interface connector having opposing contacts that reduce lateral forces within the separable connector.

Various electronic systems, such as computers, comprise a wide array of components mounted on printed circuit boards, such as daughterboards and motherboards, which are interconnected to transfer signals and power throughout the system. The transfer of signals and power between the circuit boards requires electrical interconnection between the circuit boards.

Certain interconnections include a socket assembly and a plug assembly. Some socket assemblies include spring contacts, which are configured to mate with conductive pads on the plug assembly. As the socket assembly and plug assembly mate, the spring contacts exert a normal force on the contact pads, thus ensuring proper electrical contact between the spring contacts and the conductive pads.

In order to establish adequate contact, the spring contacts wipe across the conductive pads, cleaning both surfaces, as the plug assembly is mated into the socket assembly. Typically, during mating, the spring contacts are deflected. During deflection, the spring contacts exert a resistive force on the plug assembly. The resistive force typically has normal and tangential components. The normal force is usually referred to as the contact force and the tangential force is usually caused by the frictional behavior of the wiping motion.

As electronic systems become more sophisticated, the systems require an increasing number of spring contacts and equally increasing number of conductive pads. Thus, as electronic systems become more advanced, the quantity of spring contacts within the socket assemblies increase. Conventional socket assemblies align the conductive pads in a desired pattern and orient the spring contacts in the same direction. For example, if one thousand spring contacts are included within a socket assembly all one thousand spring contacts are similarly oriented. Each spring contact includes a wiping portion that extends toward a common side of the socket assembly. As mentioned above, as the plug assembly is mated into the socket assembly, the spring contacts exert a tangential component force on the plug assembly (a component force of the total force, as discussed above). Because all of the spring contacts are oriented in the same direction, the individual tangential component forces exerted by the spring contacts add together. The sum of the tangential component forces may be great enough to cause the plug assembly to shift tangentially while being mated. When the plug assembly shifts, the spring contacts may lose contact with the conductive pads. Even if the spring contacts do not lose complete contact with the conductive pads, the spring contacts may only partially contact the conductive pads which diminishes the reliability of the electrical connection between the spring contacts and the conductive pads.

The socket assembly typically includes an enforced, robust socket frame that is formed of plastic. The socket frame typically must be robust enough to ensure that the plug assembly remains aligned within the socket assembly. That is, the socket frame acts as a barrier that contains the plug assembly. The socket frame typically needs to be strong enough to withstand the sum of the tangential component forces exerted on the plug assembly by the spring contacts. However, as more spring contacts are included within the socket assembly, the sum of the forces exerted by the spring contacts increases. As the sum of the tangential component forces increases, conventional socket frames typically need greater strength to maintain proper alignment between the plug assembly and the socket assembly. Manufacturing socket assemblies with more robust, stronger socket frames typically increases the costs of manufacture and increases the area on the printed circuit board occupied by the connector, which impacts both system cost and electrical performance. Thus, as more spring contacts are used within the socket assembly, manufacturers typically will need to develop stronger, larger and more expensive socket frames.

Thus, a need exists for a more efficient electrical connector that utilizes spring contacts. Further, a need exists for an electrical connector that maintains adequate contact between spring contacts and conductive pads. Additionally, a need exists for a separable interface electrical connector in which a plug assembly remains adequately aligned to a corresponding socket assembly. Moreover, a need exists for a separable interface electrical connector in which the cumulative lateral forces are minimized and/or substantially reduced. Also, a need exists for a more cost-efficient electrical connector.

BRIEF SUMMARY OF THE INVENTION

Certain embodiments of the present invention provide a separable interface electrical connector system. The system comprises a plug assembly and a socket assembly. The plug assembly includes a first conductive pad and a second conductive pad. The socket assembly includes first and second spring contacts, which are configured to contact the first and second conductive pads, respectively, and induce first and second tangential forces thereon. The first and second spring contacts are oriented in directions opposing one another such that upon mating of the plug assembly and the socket assembly, the first tangential component force exerted on the plug assembly by the first spring contact at least partially offsets the second tangential component force exerted on the plug assembly by the second spring contact.

The system may include a plurality of spring contacts arranged in a variety of opposing configurations. The spring contacts may be interleaved such that adjacent spring contacts are oriented in opposing directions. Optionally, the spring contacts may be arranged in sets, such that one set of spring contacts are oriented in a direction that opposes the orientation of another set.

Figure 1:
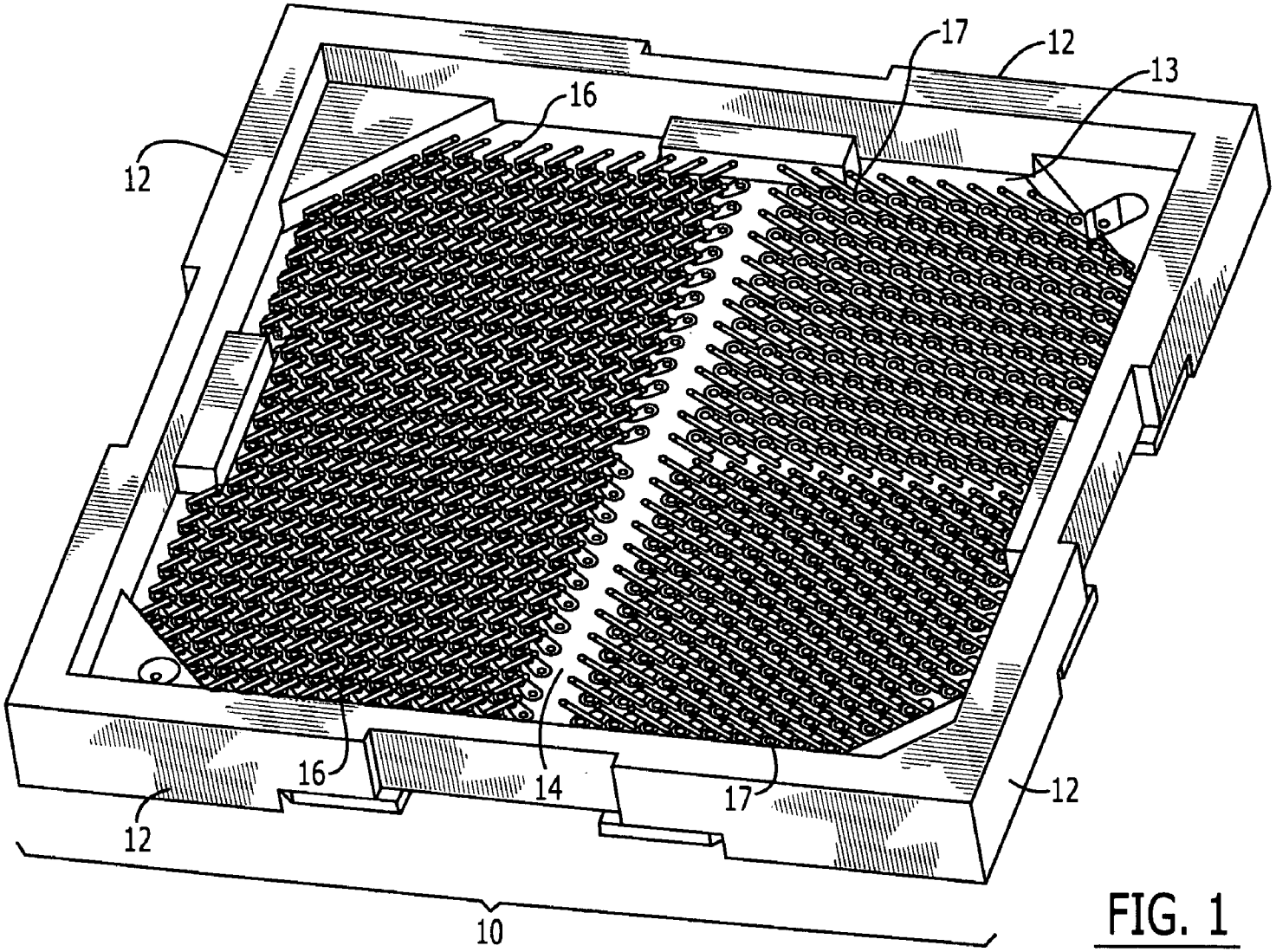
FIG. 1 illustrates a top view of a socket assembly formed in accordance with an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentalities shown in the attached drawings.

DETAILED DESCRIPTION OF THE INVENTION

FIG. 1 illustrates a top view of a socket assembly 10 formed in accordance with an embodiment of the present invention. The socket assembly 10 includes perimeter walls 12 and a base 13 that define an inner cavity 14. Spring contacts 16 and 17 are positioned within contact receptacles formed in the base 13 that receive and retain the spring contacts 16 and 17. Spring contacts 16 are oriented in a first lateral direction, while spring contacts 17 are oriented in a second lateral direction (as discussed below). Approximately half the contacts are oriented in one lateral direction, while the remaining contacts are oriented in another lateral direction. Optionally, the first and second tangential directions may directly oppose one another. As shown in FIG. 1, spring contacts 16 are in oriented as a first group, while spring contacts 17 are oriented as a second group 17.

Figure 2:
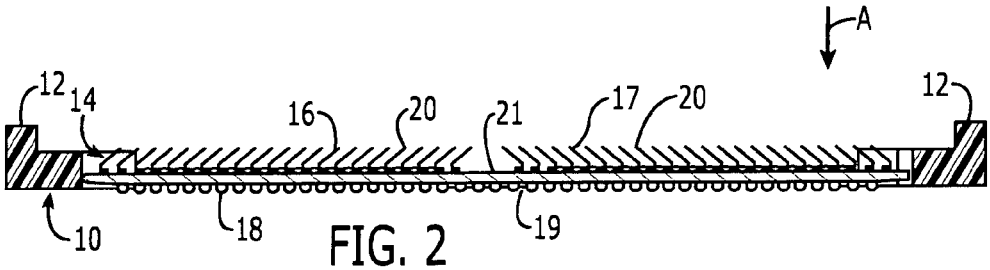
FIG. 2 illustrates a cross-sectional view of a socket assembly formed in accordance with an embodiment of the present invention.

FIG. 2 illustrates a cross-sectional view of the socket assembly 10. The inner cavity 14 is formed so that a plug assembly (not shown) may be inserted downward into the inner cavity 14 and retained by the perimeter walls 12 attached to the base 13. The socket assembly 10 includes solder balls 18 positioned on a bottom surface 19 of the socket assembly 10. The solder balls 18 connect to the spring contacts 16 and 17 through receptacles formed in the base 13.

Each spring contact 16 or 17 includes a wiping tip 20. As discussed below with respect to FIG. 5, the wiping tips 20 contact conductive pads on a plug assembly. As shown in FIG. 2, the wiping contacts 20 of each spring contact 16 and 17 extend toward a center line 21 positioned between the rows of spring contacts 16 and 17. The spring contacts 16 are oriented in a first direction such that their respective wiping contacts 20 extend parallel to one another toward the center line 21. The center line 21 is formed by a longitudinal line dividing the center of the base 13. The spring contacts 17 are oriented in a second direction such that their respective wiping contacts 20 extend toward the center line 21. In this embodiment, the spring contacts 16 in a first row (aligned with section line X—X) are aligned in the same plane as the spring contacts 17 in the same row. Thus, the spring contacts 16 are oriented in an opposite tangential direction as the spring contacts 17.

Figure 3:
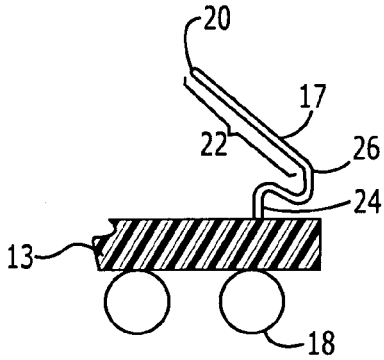
FIG. 3 illustrates a side view of a spring contact mounted on a base of a socket assembly formed in accordance with an embodiment of the present invention.

FIG. 3 illustrates a side cutout view of a spring contact 17 mounted on the base 13 of the socket assembly 10 in accordance with an embodiment of the present invention. While an exemplary spring contact 17 is shown, the spring contacts 16 include the same features except that the spring contacts 16 are oriented in an opposed direction to that of the spring contacts 17. Each spring contact 17 (and 16) includes the wiping tip 20 formed integrally with a deflectable extension portion 22. The deflectable extension portion 22 is formed integrally with a curved transition portion 26, which is in turn formed integrally with a retained portion 24. The retained portion 24 is securely retained by the base 13 of the socket assembly 10. A terminal end of the retained portion 24 contacts the solder ball 18.

Each spring contact 16 and 17 is formed of a conductive material. For example, each spring contact 16 and 17 may be formed of gold-plated nickel. Also, each spring contact 16 and 17 may have a certain elasticity that allows it to deflect upon mating of the plug assembly and the socket assembly 10.

Figure 4:
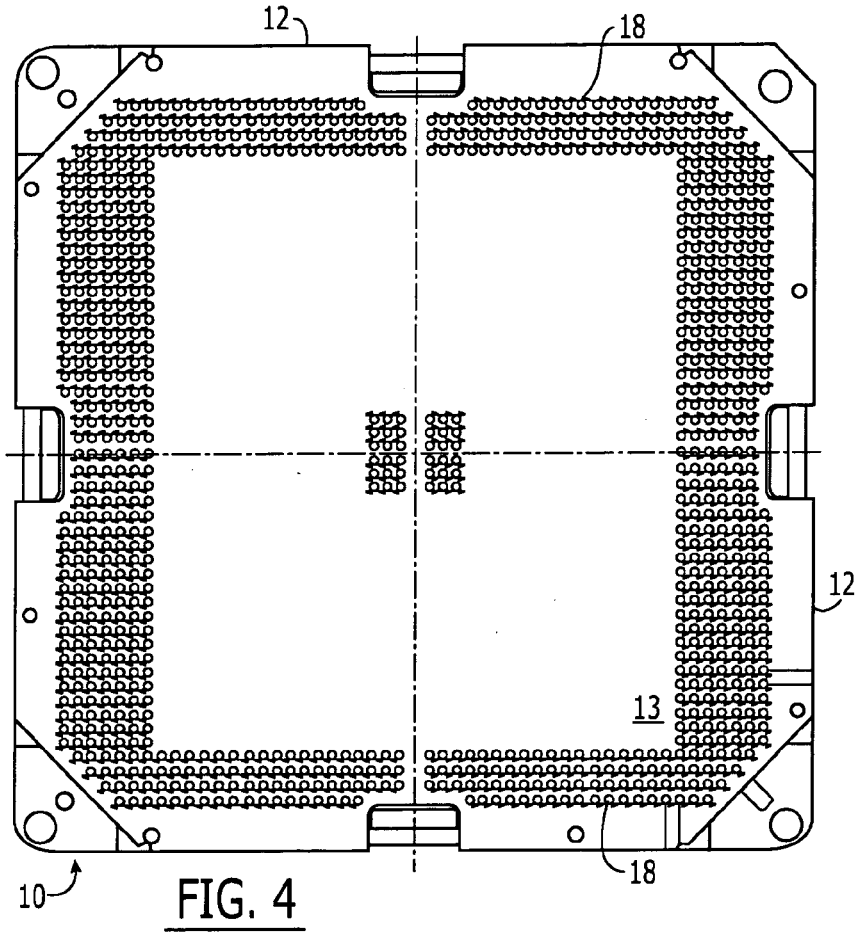
FIG. 4 illustrates a bottom view of a socket assembly formed in accordance with an embodiment of the present invention.

FIG. 4 illustrates a bottom view of a socket assembly 10 formed in accordance with an embodiment of the present invention. The socket assembly 10 is mounted on a printed circuit board (not shown). The socket assembly 10 may be reflow soldered to the printed circuit board such that an electrical connection is established between conductive portions of the printed circuit board and the spring contacts 16 and 17. For the sake of simplicity, not all the solder balls 18 are shown. Typically, the number of solder balls 18 corresponds to the number of spring contacts 16 and 17.

Figure 5:
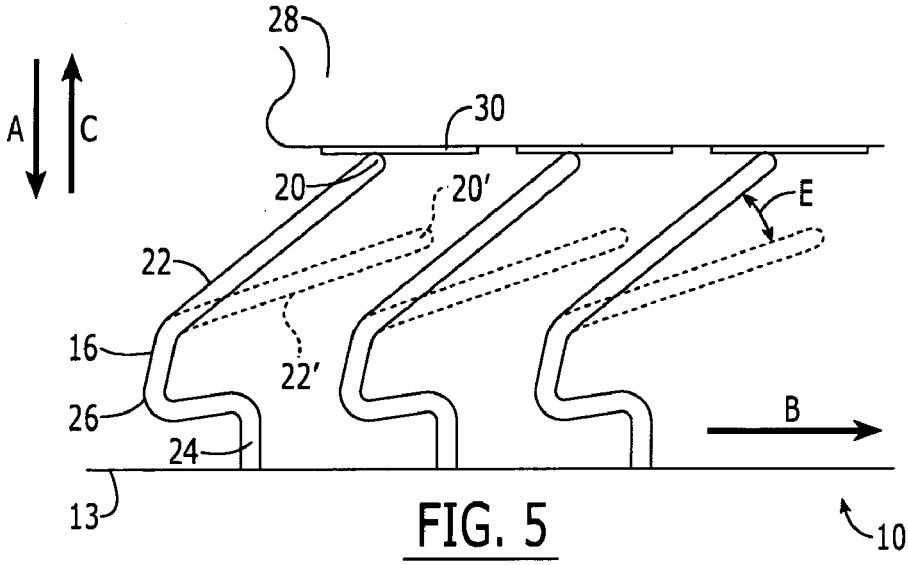
FIG. 5 illustrates a side view of a socket assembly mating with a plug assembly according to an embodiment of the present invention.

FIG. 5 illustrates a side view of a socket assembly 10 mating with a plug assembly 28 according to an embodiment of the present invention. The plug assembly 28 includes conductive pads 30. The conductive pads 30 may be formed of gold or other conductive materials. When the plug assembly 28 is mated with the socket assembly 10, the spring contacts 16 (and 17) wipe corresponding conductive pads 30. For example, as the plug assembly 28 moves into the socket assembly 10 in the direction of line A, the spring contacts 16 (and 17) exert a normal component force on the plug assembly 28 in the direction of line C. As the plug assembly 28 moves into the socket assembly 10, the plug assembly 28 deflects the deflectable extension portion 22 of the spring contacts 16 such that the wiping tips 20 wipe across the conductive pads 30. As the plug assembly 28 continues to move in the direction of line A, the wiping tips 20 continue to wipe across the conductive pads 30 and consequently move over the conductive pads 30 in the direction of line B due to the downward movement of the plug assembly 28. That is, the wiping tips 20 of the spring contacts 16 wipe the conductive pads 30 in the direction of line B.

Because there is a growing normal force between the tip of the springs and the conductive pad during the deflection of the spring, the spring contacts 16 exert a frictional force on the plug assembly 28 in the direction of line B. As shown in FIG. 5, as the spring contacts 16 wipe the conductive pads 30 in the direction of line B, the spring contacts 16 exert a tangential component force in the direction of line B onto the plug assembly. The resistive normal and tangential forces exerted by the spring contacts 16 shown by lines B and C are components of a total force (not indicated) that is exerted by the spring contacts 16. As the plug assembly 28 is mated into the socket assembly 10, the spring contacts 16 exert a total force having a tangential component force that may cause the plug assembly 28 to move or shift in the direction of line B. Upon full mating of the plug assembly 28 into the socket assembly 10, the spring contacts 16 are deflected such that the deflectable extension portions 22 are deflected as shown by reference numerals 20' and 22'. Upon full mating, the plug assembly 28 is seated in the socket assembly 10 through latch, clamp, or other engaging features located, or formed, on the plug assembly 28 and the socket assembly 10 or by external hardware.

Figure 6:
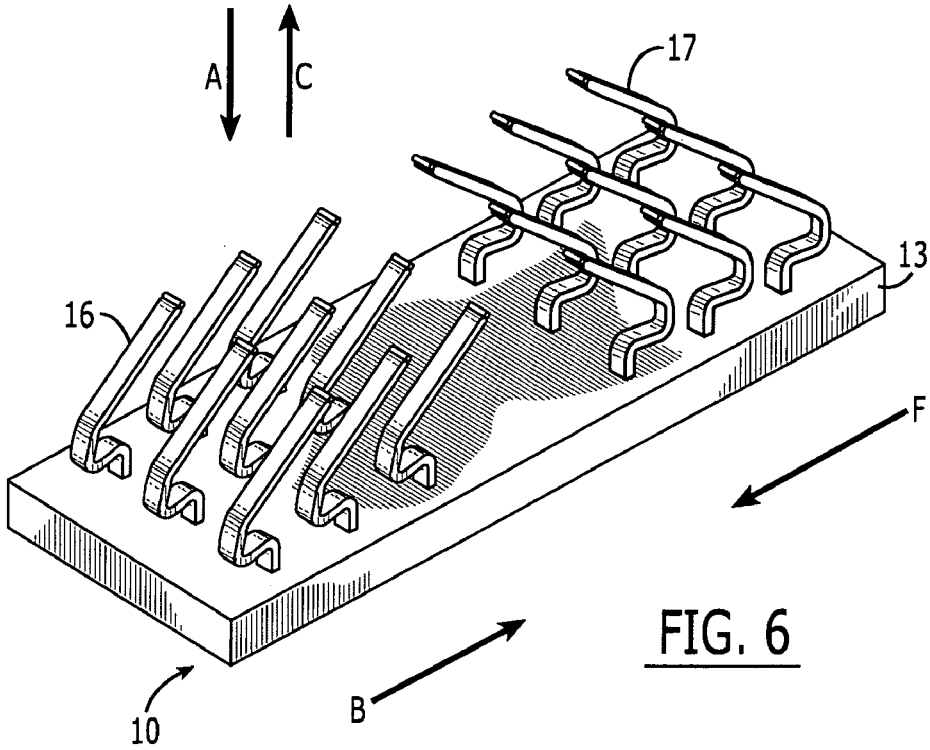
FIG. 6 illustrates an isometric view of a portion of the socket assembly having spring contacts according to an embodiment of the present invention.

FIG. 6 illustrates an isometric view of a portion of the socket assembly 10 having the spring contacts 16 and 17 according to an embodiment of the present invention. As shown in FIG. 6, the direction of the spring contacts 16 opposes the direction of the spring contacts 17. Thus, when the plug assembly 28 is mated into the socket assembly 10, the spring contacts 16 wipe corresponding conductive pads 30 in the direction of line B, while the spring contacts 17 wipe corresponding conductive pads 30 in the direction of line F. The spring contacts 16 are opposed to the spring contacts 17 in order to cancel or substantially cancel or reduce resulting tangential component forces within the separable electrical connector formed by the mating of the plug assembly 28 and the socket assembly 10.

As the plug assembly 28 is mated into the socket assembly 10 in the direction of line A, the spring contacts 16 and 17 exert a normal component force on the plug assembly 28 in the direction of line C. However, the spring contacts 16 and 17 also exert tangential component forces in opposite directions on the plug assembly 28. That is, the spring contacts 16 exert a tangential component force in a direction that is opposite to the tangential component force exerted by the spring contacts 17.

As the set of spring contacts 16 wipe in the direction of line B, the spring contacts 16 exert a tangential component force on the plug assembly 28 in the direction of line B. Also, as the set of spring contacts 17 wipe in the direction of line F, the spring contacts 17 exert a tangential component force on the plug assembly 28 in the direction of line F. Because the spring contacts 16 and 17 are formed of the same material and have the same structural behavior, the normal force exerted by a spring contact 16 is equal, or substantially equal, to the normal force exerted by a spring contact 17. However, the tangential force exerted by the spring contact 16 is equal to, but opposite that exerted by the spring contact 17. Hence, the tangential component forces (denoted by line B) exerted by the spring contacts 16 offset, reduce, cancel, or at least substantially minimize, the tangential component forces (denoted by line F) exerted by the spring contacts 17. The sum of the tangential component forces within the separable interface electrical connector is approximately zero. However, the sum of the forces does not have to be zero. Rather, the sum of the forces may be a value that is small enough to ensure adequate alignment between the socket and plug assemblies.

For example, if the proper alignment between the spring contacts 16, 17 and corresponding conductive pads 30 may be maintained with a tangential force less than or equal to a certain number of Newtons ($kg(m)/s^2$), pounds, etc., in the direction of lines B or F, then the spring contacts 16 and 17 may be configured on the socket assembly 10 in a way that limits the sum of the tangential forces to less than or equal to the permissible force. In other words, the number of spring contacts 16 does not necessarily have to equal the number of spring contacts 17. Rather, the number of spring contacts 16 and 17 may be dictated by an acceptable limit of the vector sum of the tangential forces within the separable interface electrical connector. For example, in a one thousand contact socket assembly 10, adequate alignment between the wiping tips 20 of the spring contacts 16, 17 and corresponding conductive pads 30 on the plug assembly 28 may be achieved through four hundred spring contacts 16 and six hundred spring contacts 17. While the sum of the tangential forces exerted by the spring contacts 16 and 17 may not be zero, the sum of the forces may be within tolerable levels to assure adequate alignment between the spring contacts 16, 17 and the corresponding conductive pads 30.

Figure 7:
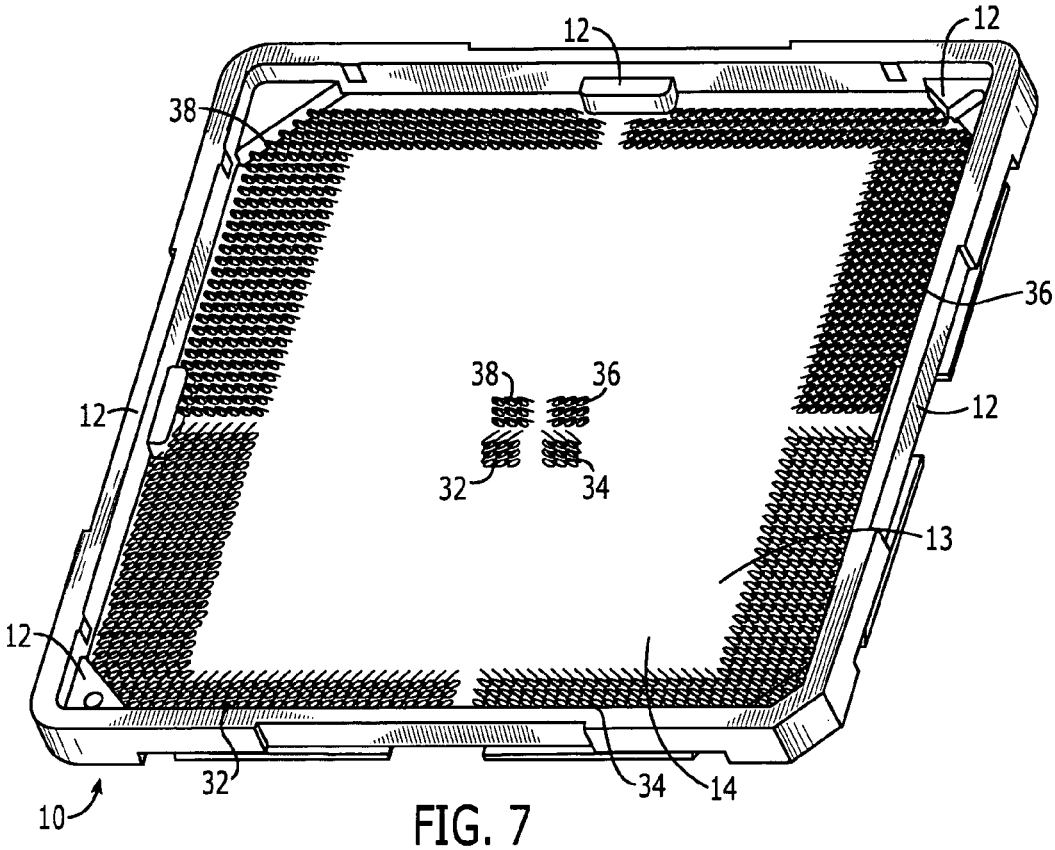
FIG. 7 illustrates an isometric view of a socket assembly formed in accordance with an embodiment of the present invention.

FIG. 7 illustrates an isometric view of a socket assembly 10 formed in accordance with an embodiment of the present invention. As an alternative to the orientation of the spring contacts 16 and 17, spring contacts 32, 34, 36 and 38 may be used within the socket assembly 10. Each set of spring contacts 32, 34, 36 and 38 are oriented in a different direction. Spring contacts 32 oppose spring contacts 36. Spring contacts 34 oppose spring contacts 38.

Figure 8:
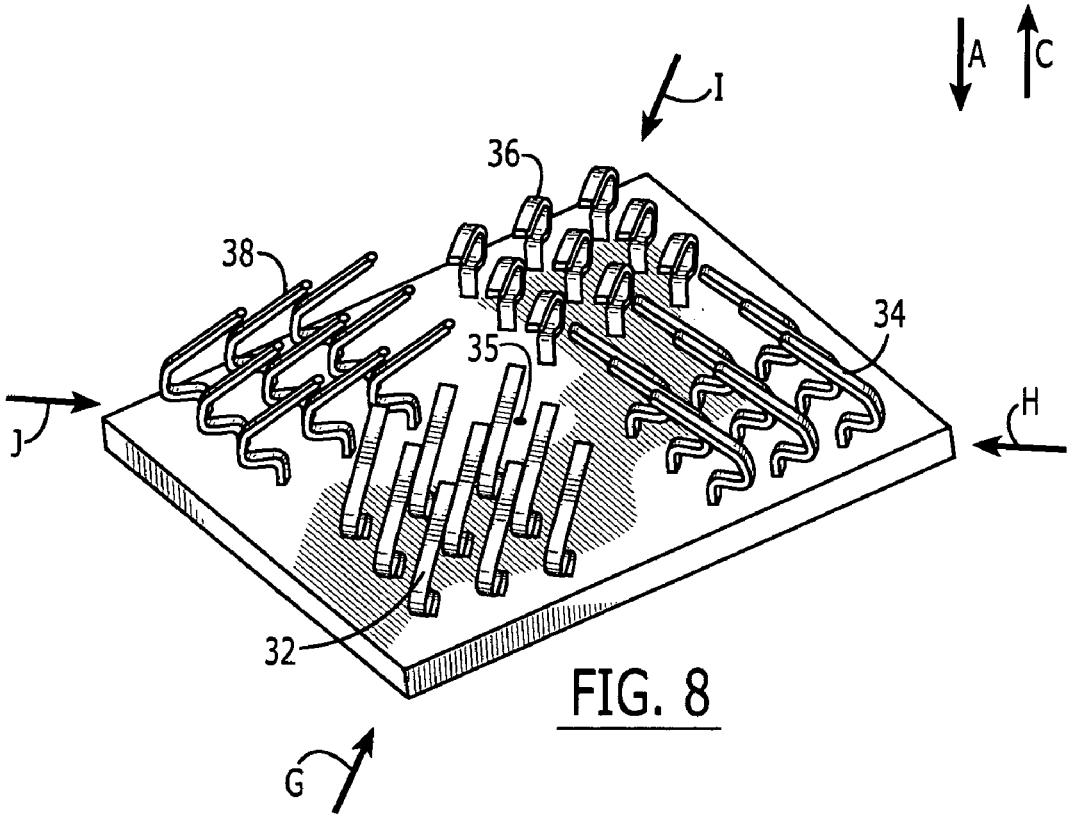
FIG. 8 illustrates an isometric view of a portion of the socket assembly having spring contacts according to an embodiment of the present invention.

FIG. 8 illustrates an isometric view of a portion of the socket assembly 10 having the spring contacts 32, 34, 36 and 38 according to an alternative embodiment of the present invention. The spring contacts 32 wipe corresponding conductive pads 30 of a plug assembly in the direction of line G. The spring contacts 32 also exert a tangential force on the plug assembly 28 (as the plug assembly 28 is mated into the socket assembly in the direction of line A) in the direction of line G. The spring contacts 34 wipe corresponding conductive pads 30 of a plug assembly in the direction of line H. The spring contacts 34 also exert a tangential force on the plug assembly 28 (as the plug assembly 28 is mated into the socket assembly in the direction of line A) in the direction of line H. The spring contacts 36 wipe corresponding conductive pads 30 of a plug assembly in the direction of line I. The spring contacts 36 also exert a tangential force on the plug assembly 28 (as the plug assembly 28 is mated into the socket assembly in the direction of line A) in the direction of line I, which is exerted in an opposite direction to that of line G. The spring contacts 38 wipe corresponding conductive pads 30 of a plug assembly in the direction of line J. The spring contacts 38 also exert a tangential force on the plug assembly 28 (as the plug assembly 28 is mated into the socket assembly in the direction of line A) in the direction of line J, which is exerted in an opposite direction to that of line H.

The tangential component forces exerted by the spring contacts 32 in the direction of line G are reduced, cancelled, or substantially diminished by the tangential component forces exerted by the spring contacts 36 in the direction of line I (and vice versa). Similarly, the tangential component forces exerted by the spring contacts 34 in the direction of line H are cancelled, or substantially diminished by the tangential component forces exerted by the spring contacts 38 in the direction of line J (and vice versa).

As mentioned above, the sum of the forces within the separable interface electrical connector formed by the mating of the plug assembly 28 into the socket assembly 10 do not necessarily have to equal zero. Rather, the vector sum of the forces may be a value that allows for adequate alignment between spring contacts and corresponding conductive pads. Further, the number of spring contacts within a set of commonly oriented spring contacts does not have to equal the number of spring contacts in the opposing set of spring contacts.

Hence, the spring contacts 32, 34, 36 and 38 are divided into four sets that are oriented with wiping tips 20 facing inward toward a focal point 35. Optionally, the spring contacts 32, 34, 36 and 38 may be oriented in an opposite direction with wiping tips 20 facing away from focal point 35. As a further alternative, spring contacts 32, 34, 36 and 38 may be oriented in other directions so long as the tangential component forces are substantially offset or minimized by one another. As yet a further alternative, individual contact springs or interleaved rows of contact springs may be oriented in opposite directions to form offsetting tangential component forces.

The opposed spring contacts may be used in a Land Grid Array (LGA) connector. However, embodiments of the present invention may be used with any type of separable interface connector that utilizes spring contacts. Further embodiments of the invention may be used with any type of electrical connector in which control of lateral shifting or moving components within the electrical connector is necessary.

Also, while FIGS. 1, 2, and 6 show one pair of groups opposing spring contacts 16 and 17 and FIGS. 7 and 8 show two pairs of groups opposing spring contacts (32, 36 and 34, 38), more pairs of groups of opposing contacts may be used within the socket assembly 10. For example, spring contacts may be positioned in octants (as opposed to quadrants), such that four pairs of opposed spring contacts are included within the socket assembly 10. Further, the spring contacts do not have to be positioned, mounted, or otherwise extend from the socket assembly 10. That is, the spring contacts may be positioned, mounted, or extend from, the plug assembly 28, while the conductive pads may be positioned within the socket assembly 10.

Embodiments of the present invention may be used with traditional stamped and molded plug and socket assemblies. The socket assembly and plug assembly may be shaped differently than the embodiments shown. For example, the socket assembly may be a circular socket assembly with the spring contacts positioned such that each wiping contact extends towards the center of the circular socket assembly.

Thus, embodiments of the present invention provide a separable interface electrical connector that maintains adequate alignment between spring contacts and conductive pads. Also, embodiments of the present invention provide a separable interface electrical connector in which a plug assembly remains adequately aligned with a corresponding socket assembly. Further, embodiments of the present invention provide a more cost-efficient electrical connector because less material, or less robust material, is needed to ensure that the plug assembly remains properly aligned with the socket assembly.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

The invention claimed is:

1. A separable interface electrical connector system comprising:

a plug assembly having a first conductive pad and a second conductive pad; and a socket assembly comprising:

a base;

opposing perimeter walls extending upwardly from said base, said base interconnecting and extending substantially an entire distance between each of said opposing perimeter walls and providing a substantially continuous contact receiving surface between said perimeter walls, said perimeter walls defining a cavity therebetween and above said base which receives said plug assembly; and surface mount contacts arranged in a pattern of crossed lines on the contact receiving surface, the contacts in the pattern forming substantially evenly distributed rows and columns of contacts spaced from one another and extending across the contact receiving surface, the contacts extending upward from said base, said contacts being divided into a first group of spring contacts in a first area of said base wherein the spring contacts of the first group are oriented in a first common direction and a second group of spring contacts in a second area of said base different from said first area, wherein the spring contacts of the second group are oriented in a second common direction different from the first common direction, said first and second groups of contacts configured to contact said first and second conductive pads, respectively, and induce first and second tangential forces thereon, said first common direction and said second common direction opposing one another such that upon mating of said plug assembly and said socket assembly, said first tangential component force exerted on said plug assembly by said first group of spring contacts at least partially offsets said second tangential component force exerted on said plug assembly by said second group of spring contacts.

2. The system of claim 1 wherein said first group and said second group of spring contacts wipe across said first and second conductive pads, respectively, in tangential directions when said plug assembly and said socket assembly are mated together.

3. The system of claim 1 wherein each of said first group and said second group of spring contacts comprises contacts having a wiping tip integrally formed with a deflectable extension portion.

4. The system of claim 1 wherein each of said first group and said second group of spring contacts comprises contacts having an end retained within a base of said socket assembly.

5. The system of claim 1 wherein said separable interface electrical connector system is a Land Grid Array (LGA) system.

6. An electrical connector system comprising:

a plug assembly having a plurality of conductive pads; and a socket assembly having a base and perimeter walls defining an inner cavity therebetween which receives said plug assembly above said base, said base occupying substantially an entire interior area between said perimeter walls, and a grid of contacts arranged on said base in spaced rows and columns intersecting one another and substantially evenly distributed within said inner cavity, said contacts extending from said base within said inner cavity at a location separate from said perimeter walls and between said perimeter walls, said grid comprising a first set of spring contacts occupying a first portion of said inner cavity and a second set of spring contacts occupying a second portion of said inner cavity distinct from said first portion, said first set of spring contacts being oriented in a first direction and said second set of contacts being oriented in a second direction, said first direction opposing said second direction, each spring contact within said first and second sets of spring contacts contacting one of said plurality of conductive pads corresponding to said first and second portions of the inner cavity.

7. The system of claim 6 wherein said grid of contacts further comprises third and fourth sets of spring contacts oriented in third and fourth directions different from said first and second directions, said third direction opposing said fourth direction.

8. The system of claim 6 wherein each spring contact within said first and second sets of spring contacts wipe one of said conductive pads when said plug assembly and said socket assembly are mated together.

9. The system of claim 6 wherein a sum of tangential resistive forces exerted on said plug assembly by said first and second sets of spring contacts equals substantially zero.

10. The system of claim 6 wherein tangential forces exerted on said plug assembly by said first set of spring contacts cancel lateral forces exerted on said plug assembly by said second set of spring contacts.

11. The system of claim 6 wherein each spring contact within said first and second sets of spring contacts comprises a wiping tip integrally formed wit a deflectable extension portion, wherein respective wiping tips of said first and second sets of spring contacts face one another.

12. The system of claim 6 wherein each spring contact within said first and second sets of spring contacts comprises multiple columns and multiple rows of contacts occupying said first and second portions, respectively, of said inner cavity, wherein adjacent rows of contacts are aligned in the same orientation within each portion.

13. The system of claim 6 wherein said electrical connector system is a Land Grid Array (LGA) system.

14. The system of claim 6 wherein an equal number of spring contacts are in each of said first and second sets of spring contacts.

15. The system of claim 6 wherein a number of spring contacts within each of said first and second sets of spring contacts is not equal.

16. A separable interface electrical connector system comprising:

a plug assembly having a plurality of conductive pads; and a socket assembly comprising:

a base having a top surface, a bottom surface, and side edges, said top and bottom surfaces extending fully between said side edges;

perimeter walls extending from said side edges of said base, said perimeter walls collectively defining an inner cavity configured to receive said plug assembly and said perimeter walls retaining said plug assembly when said plug assembly is inserted into said inner cavity between said perimeter walls;

a grid of contacts arranged about a focal point located substantially at a geometric center of the base, the contacts being arranged into first, second, third and fourth sets of spring contacts, wherein said first, second, third, and fourth sets of spring contacts are arranged in respective first, second, third and fourth quadrants upon said top surface of said base with respect to said focal point, said respective sets of contacts substantially evenly distributed in each respective quadrant and arranged in spaced rows and columns intersecting one another at a distance from said perimeter walls within said base;

wherein said first set of contacts is located only in said first quadrant, said second set of contacts is located only in said second quadrant, said third set of contacts is located only in said third quadrant, and said fourth set of contacts is located only in said fourth quadrant; and wherein said first, second, third and fourth sets of contacts are each aligned with one another within said respective quadrants and positioned to extend in different directions with respect to said focal point in said respective quadrants, wherein said first set of spring contacts is oriented in a direction opposing an orientation of said third set of spring contacts, said second set of spring contacts being oriented in a direction opposing an orientation of said fourth set of spring contacts, each spring contact within said first, second, third and fourth sets of spring contacts contacting one of said plurality of conductive pads, and each spring contact within said first, second, third and fourth sets of spring contacts wiping across one of said conductive pads when said plug assembly and said socket assembly are mated together.

17. The system of claim 16 wherein a sum of tangential resistive forces exerted on said plug assembly by said first, second, third and fourth sets of spring contacts equals substantially zero.

18. The system of claim 16 wherein tangential forces exerted on said plug assembly by said first set of spring contacts cancel tangential forces exerted on said plug assembly by said third set of spring contacts, and tangential forces exerted on said plug assembly by said second set of spring contacts cancel tangential forces exerted on said plug assembly said fourth set of spring contacts.

19. The system of claim 16 wherein each spring contact within said first, second, third and fourth sets of spring contacts comprises a wiping tip integrally formed with a deflectable extension portion.

20. The system of claim 16 wherein each spring contact within said first, second, third and fourth sets of spring contacts comprises an end retained within a base of said socket assembly.

21. The system of claim 16 wherein said electrical connector system is a Land Grid Array (LGA) system.

22. The system of claim 16 wherein a number of spring contacts within each of said first, second, third and fourth sets of spring contacts is equal.

23. The system of claim 16 wherein a number of spring contacts within each of said first, second, third and fourth sets of spring contacts is not equal.

* * * * *